United States Patent [19]

Kernbichler et al.

[11] 4,315,419

[45] Feb. 16, 1982

[54] CONTOURED PILE FABRIC AND A PROCESS FOR THE PREPARATION THEREOF

[75] Inventors: Bert Kernbichler, Obertshausen; Christian Wilkens, Heusenstamm, both of Fed. Rep. of Germany

[73] Assignee: Karl Mayer Textilmaschinenfabrik GmbH, Obertshausen, Fed. Rep. of Germany

[21] Appl. No.: 113,582

[22] Filed: Jan. 21, 1980

[30] Foreign Application Priority Data

Feb. 5, 1979 [DE] Fed. Rep. of Germany ..... 2904203

[51] Int. Cl.[3] ..... D04B 23/02

[52] U.S. Cl. ..... 66/87; 66/196; 66/194

[58] Field of Search ..... 66/87, 88, 196, 192, 66/193, 194

[56] References Cited

U.S. PATENT DOCUMENTS 3,855,820 12/1974 Kohl ..... 66/87

3,921,418 11/1975 Apken ..... 66/87

*Primary Examiner*—Ronald Feidbaum

*Attorney, Agent, or Firm*—Omri M. Behr

[57] ABSTRACT

A process for the manufacture of contoured pile ware on a conventional double needle bar warp knitting machine yields textured pile fabric with an unusual appearance. The pattern is formed of pile threads of different length and in different positions in the pile ribs and are bound together with the base fabric. The ware is formed on a twin bed warp knitting machine and subsequently is cut to form two individual panels.

13 Claims, 34 Drawing Figures

FIG. 9
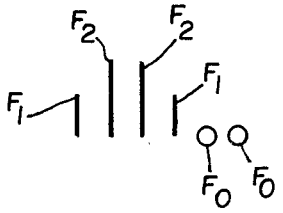
FIG. 9b
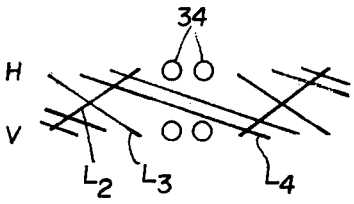
FIG. 9b
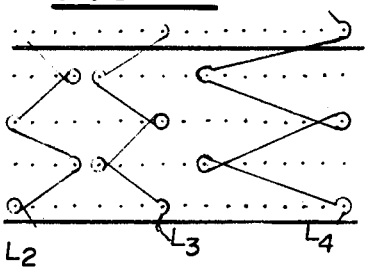
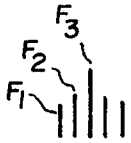
FIG. 10
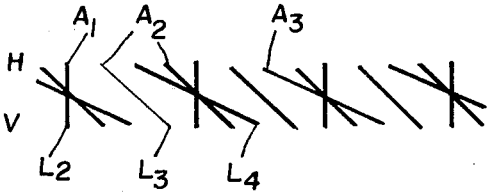
FIG. 10a
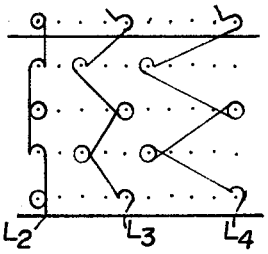
FIG. 10b
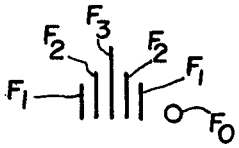
FIG. 11
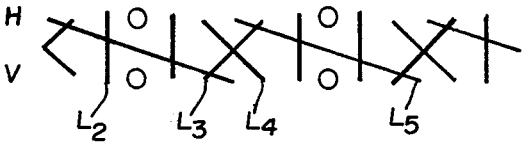
FIG. 11a
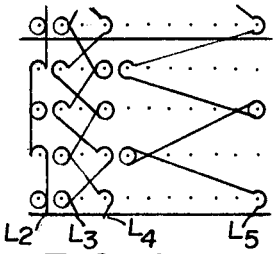
FIG. 11b
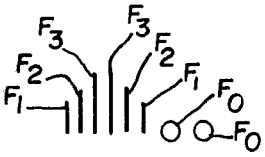
FIG. 12
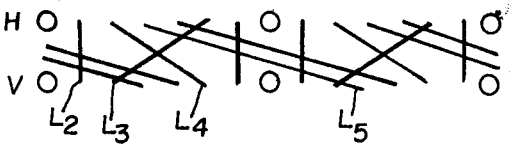
FIG. 12a
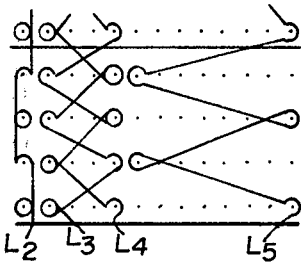
FIG. 12b
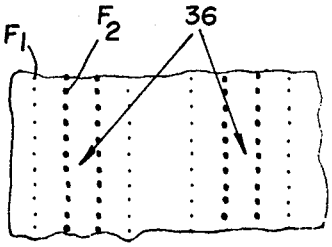
FIG. 13
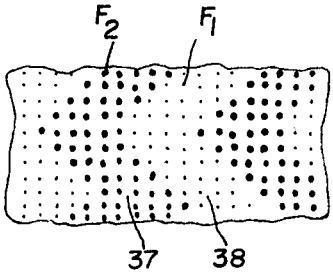
FIG. 14

CONTOURED PILE FABRIC AND A PROCESS FOR THE PREPARATION THEREOF

BACKGROUND OF THE INVENTION

1. Field of the Invention

The present invention relates to the manufacture of pile fabric, and in particular to the formation of textured pile fabric on a warp knitting machine wherein a pattern is formed thereon by pile threads of different length.

2. Description of the Relevant Art

A process used in the manufacture of woven materials utilizes partial weft threads, which at the turning position, are bound off with the stitches of the base fabric. The portions between the turning positions lie freely on the base fabric to form hollow ribs. The ribs are then individually cut open to provide pile ribs.

Utilizing this procedure only straight warp ribs may be provided as the pile pattern. Also, it is not possible to provide pile threads of the same length to each adjacent stitch in the warp direction so that either a pile of lesser density or a pile without a distinct high profile characteristic is provided. Moreover, it is not possible to provide a pile rib which has a lower height or thickness at the edge than in the center of the rib or a rib which has different pile thread lengths in each stitch row. Since the segments to be cut apart must correspond to a separation of several needle widths, the height of the pile cannot be freely chosen. Moreover, the width of the ribs are limited since the length of the pile threads becomes too long when greater rib widths are chosen. The cutting open of the hollow ribs is tedious, time consuming, expensive and subject to substantial errors which reduce the yield of the ware. It is necessary to utilize a thread cutting needle which utilizes two separate shafts that is inserted into each rib opening space by manual means. These needles often stray into the material and either cut the material or break the needle. A manually introduced circular knife cuts the partial weft threads forming the hollow ribs by inserting between the two shafts of the thread cutting needle. Since the pile threads cut open in this manner lie flat on the base fabric, they must be subjected to an additional brushing operation in order to have them stand upright.

SUMMARY OF THE INVENTION

The present invention discloses a method wherein a warp knitting machine may be utilized to provide textured pile fabric with a choice of shape, pile density, height, and variations in the height profile of the pattern formed by different lengths of pile threads. All this may be accomplished with a greater freedom of choice as well as a work speed heretofore unobtainable.

The advantages set forth above may be accomplished by utilizing a double needle bed warp knitting machine wherein the pile threads are laid over the needle forming the base fabric from one to the other of the needle beds. At least two guide bars are utilized to supply the pile building threads. These threads move from one needle bed to the other and are laid with different displacements. By cutting across the entire breadth of the material, two separate panels of goods are provided.

Utilizing the present process the free sections of the pile building threads are cut through the middle thereof. The different lengths of the individual threads are formed by displacing the threads when they move from one needle bed to the other. Thus, it is possible to provide pile threads of the same length not only in adjacent stitches of the base fabric in the warp direction, but also perpendicular thereto. Thus, it is possible to provide a substantially high pile density while at the same time provide a recognizable and distinctive pile height profile. Since the form of the pattern is not dependent on the cutting procedures, it is possible to provide the desired patterns from threads of different lengths. In particular, all stitches of the ground ware may be occupied by pile threads and the pattern formed solely by the difference in length of the pile threads. The height of the pile may be changed by changing the separation of the needle beds.

With the process as set forth, when the needle groups on each needle bed are lapped with pile threads and with the threads in the middle of the needle group provided with a greater displacement than those at the edge of the needle group, a pile profile having a height at the edge which is substantially less than the height in the middle is obtained. It is also possible to provide pile ribs by this process which run in the warp directions as in conventional corduroy material. When the needle groups are displaced sideways in every lap, diagonal rib patterns may be provided.

Generally, the pile threads are placed on both needle beds on similar needle groups. Thus, two equivalent panels of goods are provided which have no variations therebetween. In this manner it is possible to provide needles which generate ground ware but are held free of pile forming threads. Thus, in forming the pattern, parts of the upper surface of the base fabric may be utilized. With the same needles always held free then open passageways are provided between the piles creating a pile rib such as the known corduroy effect. It is also possible to displace the needles on one needle bed from that on the other which are to be held free of the pile threads. This simplifies the choice of the required displacement for certain pile thread lengths.

It is also possible to lay the pile forming threads over the first needle group on the first needle bed and on the needles of at least two needle groups on the other needle bed. In this manner, substantial lapping differences may be obtained between the pile threads. It is also possible to achieve different pile thread lengths by laying the pile threads across each other with different displacements.

Greater pile density may be obtained by leading the pile forming threads of the first needle on the first needle bed to at least two needles on the other needle bed. After cutting, this yields two or more pile threads on a single stitch.

The process for fabricating knitted fabric having patterns formed thereon by pile threads of different lengths on a double needle bed warp knitting machine having two needle beds and a plurality of guide bars associated therewith, according to the principles of the present invention comprises the steps of: (a) knitting the pile forming threads carried by a first guide bar about the needles forming the base fabric on a first needle bed, (b) knitting the first guide bar thread about the needles of the second needle bed and returning to step (a), (c) knitting the pile forming threads carried by a second guide bar about the needles forming the ground ware on the first needle bed, (d) knitting the second guide bar threads about the needles of the second needle bed and returning to step (c), the first guide bar and the second guide bar being provided with different displacements when moving between the first and second needle beds, and (e) centrally cutting the pile forming threads appearing between the fabric formed by the first and second needle bars along the entire width of the ware to form two separate panels.

BRIEF DESCRIPTION OF THE DRAWINGS

In order that the invention may be more fully understood, it will now be described, by way of example, with reference to the accompanying drawing in which:

FIGS. 4, 4*a* and 4*b* through FIGS. 12, 12*a* and *b* respectively, show the arrangement of pile threads for a particular embodiment of a panel of fabric, show a plan view of the positioning of the pile forming threads, and show the lapping diagram for the different wares;

FIG. 13 is a schematic plan view of knitted fabric with ribs corresponding to that shown in FIG. 8; and FIG. 14 is a schematic plan view of knitted ware having a zig-zag pattern which is sculptured or textured.

DESCRIPTION OF THE PREFERRED EMBODIMENT

Figure 1:
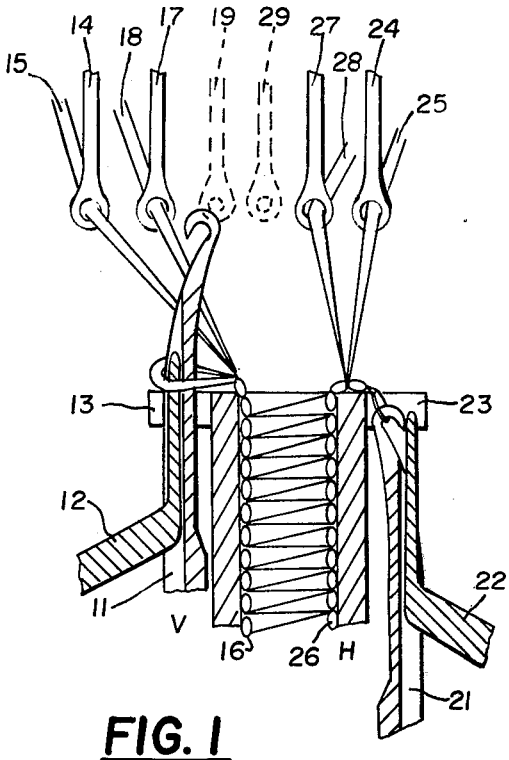
FIG. 1 is a schematic cross-section through the working area of a twin-bed warp knitting machine which may be utilized to perform the process according to the principles of the present invention.

Referring now to the figures, and in particular to FIG. 1, showing the working area of a right-warp knitting machine (Raschel), which includes a forward needle bed V with needles 11 and a rearward needle bed H with needles 21. The needles 11 and 21 are provided with sliders 12 and 22, respectively, and are positioned between knockover sinkers 13 and 23, respectively. The needle 11 cooperates with a guidebar 14 having a plurality of guides thereon which lay a ground thread 15 about the needle 11 in order to provide a forward ground ware 16.

In a similar manner, a guidebar 24 is provided with a plurality of guides for the laying of ground threads 25 which are laid about needles 21 so that a rearward ground ware 26 is provided. Additional guidebars 17 and 27, each having a plurality of guides, are utilized to provide the pile forming threads 18 and 28, which alternately are laid about the forward needles 11 and the rearward needles 21. These pile threads are bound in with the stitches of the ground ware either in the formation of stitches thereof or may be utilized to form pile threads by being bound into the base fabric stitches and extending between the forward and rearward needle beds. If desired, additional guidebars, 19 and 29 (shown dotted in FIG. 1) may be utilized to form the ground threads, may be utilized for pile forming threads, or may be utilized for additional thread forming systems.

Figure 2:
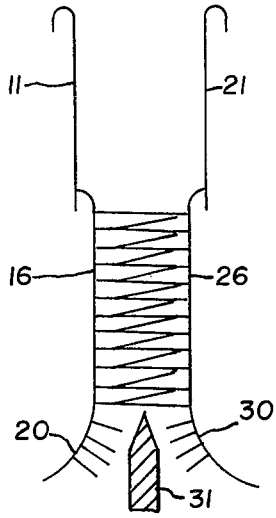
FIG. 2 is a schematic illustration of the positioning of the cutting knife with respect to the warp knitting machine shown in FIG. 1.

As shown in FIG. 2, the fabric or goods produced in the aforementioned manner are cut into two ware panels 20 and 30, in a conventional manner by means of a knife 31 extending across the entire width of the goods. In the present application the knife 31 is an integral part of the Raschel warp knitting machine. However, the cutting knife may be separated from the knitting machine itself, if desired.

Figure 3:
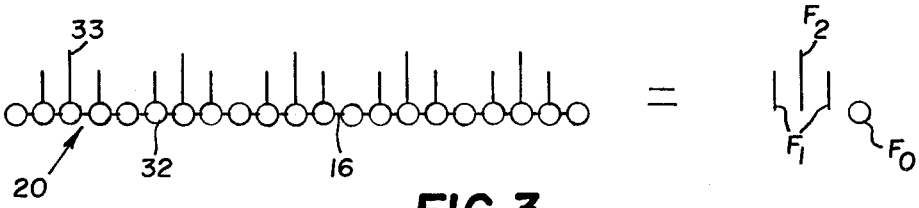
FIG. 3 shows the arrangement of the pile threads in one embodiment of a panel of ware.
Figure 3A:
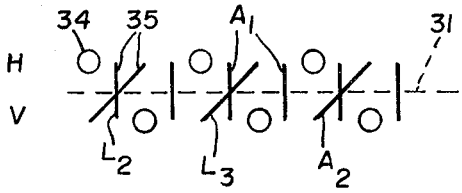
FIG. 3*a* is a plan view of the positioning of the pile forming threads.

FIG. 3 is a pictorial representation of a cross-sectional view of a panel of goods 20 wherein the pile threads 33 are of different lengths and are bound into stitches 32 of the ground ware 16. The repeat pattern is shown at the righthand side of FIG. 3 as pile threads $F_1$ and $F_2$ as well as the unoccupied position $F_0$. This pattern may, for example, be provided by the procedure pictured in FIG. 3*a* which requires the placement of the pile forming threads between the forward needle bed V and the rearward needle bed H. The needles that are kept free from pile forming threads are shown by the circle 34. The needles occupied by the pile forming thread are indicated by the ends 35 of the segments $A_1$ and $A_2$ of the pile forming threads 18 and 28, respectively, which stretch between the needle beds V and H.

Note that the system of the thread segment $A_1$ does not have any displacement when it moves from the forward to the rearward needle bed, while the system of segment $A_2$ shows the displacement of two needle spaces. When the segments $A_1$ and $A_2$ are cut by the knife 31, in the middle thereof, the thread pile segment of FIG. 3 is provided.

Figure 3B:
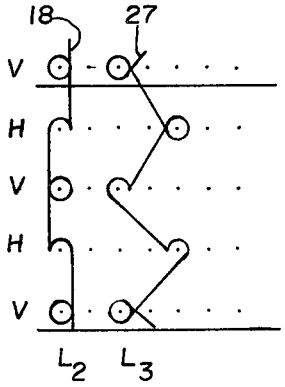
FIG. 3*b* is the lapping diagram for the pile forming threads shown in FIG. 3*a;*

The lapping diagram shown in FIG. 3*b* is the movement of guidebars $L_2$ and $L_3$, not shown, each of which have affixed therein a plurality of guides that are represented by the guides 17 and 27 respectively, as illustrated in FIG. 1. Guidebar $L_2$, which controls the movement of thread segment $A_1$ is lead without sideward displacement alternately between the needles of the forward and rearward needle beds. The guidebar $L_3$, not shown, which contains guide 27 produces segment $A_2$ and is similarly lead between the forward and rearward needle beds. However, guide 27 is displaced by two needle spaces.

Figure 4:
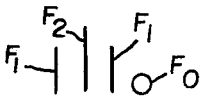
Figure 4A:
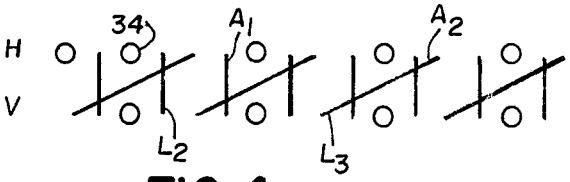
Figure 4B:
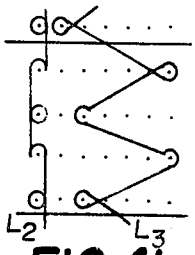
Figure 5:
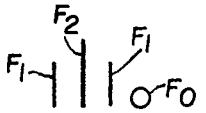
Figure 5A:
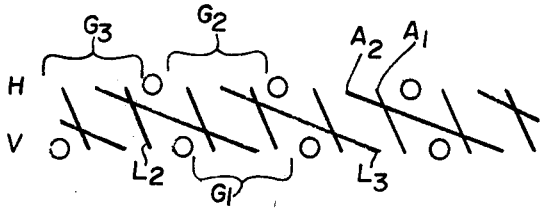
Figure 5B:
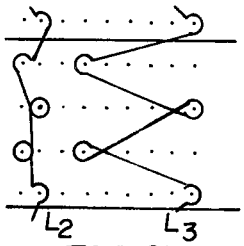
Figure 6:
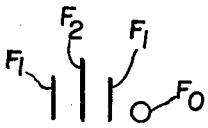
Figure 6A:
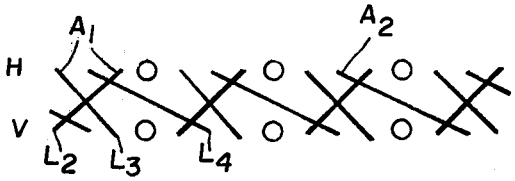
Figure 6B:
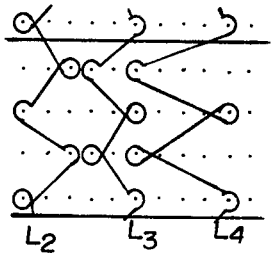

FIGS. 4*a*, 5*a* and 6*a* show the positioning of the pile forming threads of the fabric shown in cross-section in FIGS. 4, 5 and 6 with their corresponding lapping diagrams shown in FIGS. 4*b*, 5*b* and 6*b*. In FIG. 4*a* the unoccupied needles 34 lie opposite each other in each of the needle beds H and V. This permits the production of a section $A_2$ of greater length so that the pile thread $F_2$ has a greater length. In FIG. 5*a* the shorter segment $A_1$ also is given a sideward displacement from the needle spacing and the segment $A_2$ is displaced by four needle spaces. This yields a substantially longer pile thread. In FIG. 6*a* the shorter segments $A_1$ cross each other so that the already shorter segments have a sideward displacement of two needle spaces and thus, are given a correspondingly greater length. In order to operate in this manner, however, it is necessary to utilize three guidebars $L_2$, $L_3$, and $L_4$, not shown, but are represented by guides 14, 17 and 19, which are positioned proximate the forward needle bed V and guides 24, 27, and 29 which are positioned proximate the rearward needle bed H. As noted earlier the lapping diagrams for each of the different configurations are shown in FIGS. 4*b*, 5*b*, and 6*b*.

As shown in FIG. 5*a*, the adjacent needles of one needle bed provide for a pattern group designated respectively as $G_1$, $G_2$, and $G_3$, which have in the center thereof a longer pile thread $F_2$ and a shorter pile thread $F_1$ occurring at the edges. The threads of the first group $G_1$ on the forward needle bed V are stretched over the two groups $G_2$ and $G_3$ on the rearward needle bed H. A cross-section of the fabric obtained is shown in FIG. 5.

Figure 7:
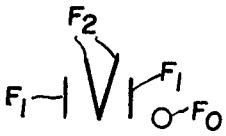
Figure 7A:
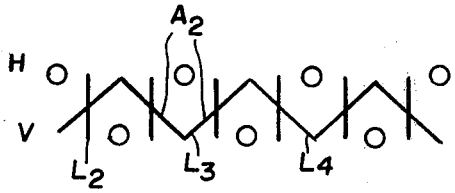
Figure 7B:
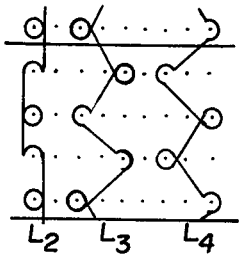

In FIGS. 7 and 7*a* the central needle of a group is lapped about a needle with two pile forming thread segments $A_2$ so that there is provided a denser pile having two longer threads $F_2$. To obtain this type of ware, three guidebars $L_2$, $L_3$, and $L_4$ are required. The lapping diagram for the fabric shown in FIG. 7 appears in FIG. 7*b*.

Figure 8:
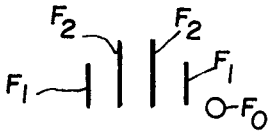
Figure 8A:
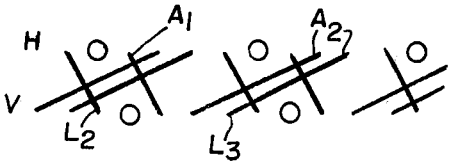
Figure 8B:
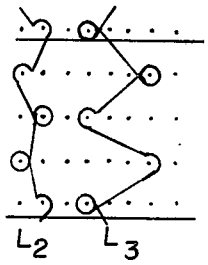

FIGS. 8 and 8*a* show how two central needles of a group can be lapped about with the longer pile forming segments $A_2$ with the two outer needles having shorter segments $A_1$ forming shorter pile threads at the edges. The lapping diagram therefor is shown in FIG. 8*b*.

FIGS. 9 and 9*a* show a similar arrangement with two unoccupied needles 34 located between the needle groups laid about with the pile forming threads. The lapping diagram is shown in FIG. 9*b*.

FIGS. 10 and 10*a* show a pile thread arrangement with three different lengths of pile threads namely, $F_1$, $F_2$, and $F_3$ which provide corresponding differently displaced segments $A_1$, $A_2$, and $A_3$. The lapping diagram therefor is shown in FIG. 10*b*. Similarly, the arrangement of FIGS. 11, 11*a* and the associated lapping diagram shown in FIG. 11*b* provides one unoccupied needle between each needle group.

In FIGS. 12 and 12*a* the occupied needle group includes six needles wherein three separate pile thread lengths are each provided twice in a symmetrical manner. The lapping diagram therefor is shown in FIG. 12*b*.

Although in FIGS. 3 through 12 there is described the formation of pile ribs having various pile thread lengths as shown in the cross-sectional profile, it is to be understood, that those knowledgable in the art can create different patterns than those disclosed. Utilizing the process as set forth herein these patterns can be created on a double needle bed Raschel machine as well as on an automatic warp knitting machine.

In FIG. 13 the larger diameter dots correspond to the longer pile threads $F_2$ and the smaller diameter dots correspond to the shorter pile threads $F_1$ as shown in the cross-sectional view shown in FIG. 8. In the pattern region all stitches both in the warp direction and perpendicular thereto are occupied by pile threads so that straight ribs 36 are produced which have a high pile density at the edge as well as in the center but in cross-section have a wave-like profile.

FIG. 14 shows a typical knitted ware which may be provided throughout as a velour ware having zig-zag ribs 37 with pile threads of relatively long length. The area 38 between the zig-zag ribs have pile threads of shorter length, thereby forming a textured zig-zag design. Other textured designs may be readily formed by the process as set forth herein by those knowledgable in the art.

Warp knitted fabric produced in accordance with the present process provides for many new pattern possibilities. Thus, in the warp knitting direction neighboring stitches of the base fabric may be provided with pile threads of the same length so that a high pile density can be provided by varying the height of the pile thread. The pattern may differ from either straight rib, zig-zag ribs or any other textured design which may be left to the imagination of the individual. A patterned velour may be provided with the present process with an infinite variation in the designs.

By utilizing the present process, for example, one may simulate animal fur where there are different areas having different pile thread lengths. Furthermore, patterns may be provided where the length of the thread is less at the edges thereof so that a textured effect may be obtained.

Hereinbefore has been disclosed a process and ware having unique characteristics. The process may be applied to a warp knitting machine to create textured ware with pile threads having increased length in the center and decreased lengths at the edges thereof creating an infinite number of pattern varieties. It will be understood that various changes in the details, materials, arrangement of parts and operating conditions which have been herein described and illustrated to explain the nature of the invention may be made by those skilled in the art within the principles and scope of the present invention.

Having thus set forth the nature of the invention, what is claimed is:

1. A process for fabricating knitted fabric having patterns formed thereon by pile threads of different lengths on a double needle bed warp knitting machine including two needle beds and a plurality of guidebars associated therewith comprising the steps of:

(a) knitting the pile forming threads carried by a first guidebar about the needles forming the ground fabric on a first needle bed;

(b) knitting said first guidebar pile forming threads about the needles of a second needle bed and returning to step (a);

(c) knitting the pile forming threads carried by a second guidebar about the needles forming the ground fabric on said first needle bed;

(d) knitting said second guidebar pile forming threads about the needles of a second needle bed and returning to step (c); said first guidebar and said second guidebar being provided with different displacements when moving between said first and second needle beds; and (e) centrally cutting said pile forming threads appearing between the fabric formed by said first and second needle bars along the entire width of said fabric to form two separate panels.

2. The process according to claim 1 wherein said pile forming threads are knitted about predetermined needle groups, said pile forming threads in the middle of said group being provided with a larger displacement than said pile forming threads at the edge of said needle group.

3. The process according to claim 2 wherein said pile forming threads are laid about the same needle groups on each said needle bed in the same manner.

4. The process according to claim 2 wherein needles utilized for the formation of base fabric disposed between said needle groups are maintained free of said pile forming threads.

5. The process according to claim 4 wherein said needles maintained free of pile forming threads in said first needle bed are displaced relative to the corresponding needles in said second needle bed.

6. The process according to claim 2 wherein said pile forming threads of a first needle group in said first needle bed are laid across needles from at least two needle groups in said second needle bed.

7. The process according to claim 1 wherein said pile threads cross each other.

8. The process according to claim 1 wherein said pile forming threads laid about a first needle in said first needle bed are laid across at least two needles in said second needle bed.

9. Pile fabric fabricated according to claim 1 wherein said pile threads are of different lengths.

10. Pile fabric according to claim 9 wherein pile threads disposed in adjacent stitches of the ground ware in the direction of the warp are the same length.

11. Pile fabric according to claim 9 wherein said pile threads are of different lengths and form a zig-zag or non-linear ribbed pattern.

12. Pile fabric according to claim 9 made in the form of velour wherein the pattern effect is formed by said pile threads having different lengths.

13. Pile fabric according to claim 9 wherein said pile thread length is shorter at the edge of a pattern and longer in the middle of the pattern.

* * * * *